US011591184B2

(12) United States Patent
Cervera et al.

(10) Patent No.: US 11,591,184 B2
(45) Date of Patent: Feb. 28, 2023

(54) ELEVATOR ASSEMBLY WITH COUNTERWEIGHT BLOCKING STOP

(71) Applicant: Otis Elevator Company, Farmington, CT (US)

(72) Inventors: Francisco Cervera, Madrid (ES); Eneko Arribas Cano, Vizcaya (ES); Jesus Donaire Serrano, Vizcaya (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 420 days.

(21) Appl. No.: 16/919,658

(22) Filed: Jul. 2, 2020

(65) Prior Publication Data

US 2021/0002101 A1 Jan. 7, 2021

(30) Foreign Application Priority Data

Jul. 5, 2019 (EP) ..... 19382577

(51) Int. Cl.

*B66B 5/00* (2006.01)
*B66B 1/34* (2006.01)
*B66B 3/00* (2006.01)

(52) U.S. Cl.

CPC ..... *B66B 5/0075* (2013.01); *B66B 1/3469* (2013.01); *B66B 3/004* (2013.01); *B66B 5/0062* (2013.01)

(58) Field of Classification Search

CPC ..... B66B 5/0075; B66B 5/0062; B66B 5/005; B66B 1/3469; B66B 3/004; B66B 5/0056

See application file for complete search history.

(56) References Cited

U.S. PATENT DOCUMENTS 5,727,657 A * 3/1998 Foelix ..... B66B 5/005 187/356
7,650,969 B2 * 1/2010 Monzon ..... B66B 5/06 187/300
7,891,467 B2 * 2/2011 Kattainen ..... B66B 5/0056 187/394

(Continued)

FOREIGN PATENT DOCUMENTS

CN 109573773 A 4/2019
DE 102017004719 A1 11/2018

(Continued)

OTHER PUBLICATIONS

European Search Report for application EP 19382577.5, dated Jan. 8, 2020, 85 pages.

*Primary Examiner* — Michael A Riegelman
(74) *Attorney, Agent, or Firm* — Cantor Colburn LLP

(57) ABSTRACT

An elevator assembly (1) comprises an elevator car (2), a counterweight (4), and a safety device (8) located on a roof (9) of the elevator car (2). A locking handle (10) is positioned within the elevator shaft (6), and connected to a first end (12*a*) of a tension member (12). A blocking stop (14) is connected to a second end (12*b*) of the tension member (12). The blocking stop (14) is moveable between an inactive state, in which the tension member (12) holds the blocking stop (14) in a position in which it does not limit downwards movement of the counterweight (4), and an active state, in which tension in the tension member (12) is reduced to allow the blocking stop (14) to move to a position in which it limits downwards movement of the counterweight (4).

15 Claims, 7 Drawing Sheets

(56) References Cited

U.S. PATENT DOCUMENTS

| | | | | |
|---|---|---|---|---|
| 8,028,808 | B2 * | 10/2011 | Gonzalez Rodil | B66B 5/0081 187/377 |
| 8,162,108 | B2 * | 4/2012 | Sirigu | B66B 13/16 187/394 |
| 8,261,885 | B2 * | 9/2012 | Ketoviita | B66B 5/0056 187/314 |
| 8,985,280 | B2 * | 3/2015 | Kauppinen | B66B 1/30 187/382 |
| 9,505,588 | B2 * | 11/2016 | Guillot | B66B 7/027 |
| 9,809,420 | B2 * | 11/2017 | Fauconnet | B66B 5/18 |
| 10,457,522 | B2 * | 10/2019 | Creel, Jr. | B66B 5/0056 |
| 10,919,731 | B2 * | 2/2021 | Talonen | B66B 5/0056 |
| 11,078,043 | B2 * | 8/2021 | Rocher | B66B 5/005 |
| 11,267,676 | B2 * | 3/2022 | Häderer | B66B 7/06 |
| 2004/0251086 | A1 * | 12/2004 | Huber | B66B 5/005 187/343 |
| 2009/0183955 | A1 * | 7/2009 | Gonzalez Rodil | B66B 5/0081 187/404 |
| 2009/0321192 | A1 * | 12/2009 | Kattainen | B66B 5/0056 187/279 |
| 2018/0186600 | A1 * | 7/2018 | Krämer | B66B 5/0093 |
| 2018/0229966 | A1 * | 8/2018 | Karimpanackal Natarajan | B66B 9/00 |
| 2018/0327222 | A1 * | 11/2018 | Rocher | B66B 9/00 |
| 2021/0002101 | A1 * | 1/2021 | Cervera | B66B 1/3469 |
| 2022/0048731 | A1 * | 2/2022 | Russell | B66B 1/3446 |

FOREIGN PATENT DOCUMENTS

| | | | |
|---|---|---|---|
| EP | 1052212 | A1 | 11/2000 |
| EP | 1026116 | B1 | 5/2004 |
| EP | 1466853 | A1 | 10/2004 |
| EP | 1473264 | A1 | 11/2004 |
| EP | 1479637 | A1 | 11/2004 |
| EP | 1882666 | A1 | 1/2008 |
| EP | 2070858 | A1 | 6/2009 |
| EP | 2488435 | B1 | 6/2013 |
| EP | 2896587 | A1 | 7/2015 |
| EP | 2222589 | B1 | 5/2016 |
| EP | 2297016 | B1 | 11/2017 |
| EP | 2998260 | B1 | 10/2018 |
| JP | 2005170565 | A | 6/2005 |
| WO | 2008002300 | A1 | 1/2008 |
| WO | 2008081074 | A1 | 7/2008 |
| WO | 2012025774 | A1 | 3/2012 |
| WO | 2019063407 | A1 | 4/2019 |

* cited by examiner

ELEVATOR ASSEMBLY WITH COUNTERWEIGHT BLOCKING STOP

FOREIGN PRIORITY

This application claims priority to European Patent Application No. 19382577.5, filed Jul. 5, 2019, and all the benefits accruing therefrom under 35 U.S.C. § 119, the contents of which in its entirety are herein incorporated by reference

TECHNICAL FIELD

This disclosure generally relates to the field of elevator maintenance, and more specifically, to maintaining a certain amount of overhead clearance above an elevator car within an elevator shaft. This is achieved through the use of a system to limit the downwards movement of a counterweight coupled to the elevator car.

BACKGROUND

It is known for an elevator system to comprise a safety device located on a roof of an elevator car and provide means for activating a blocking stop to limit downwards movement of a counterweight, therefore ensuring that a maintenance person is safely accommodated with sufficient overhead clearance above the roof of the elevator car. It is important to ensure that the blocking stop is always active whenever the safety device is deployed.

SUMMARY

According to a first aspect of this disclosure, there is provided an elevator assembly, comprising: an elevator car arranged to move in an elevator shaft; a counterweight coupled to the elevator car and arranged to move upwards and downwards in the elevator shaft; a safety device located on a roof of the elevator car and moveable between a deployed position, in which it extends away from the roof of the elevator car, and an undeployed position in which it is stowed on the roof of the elevator car; a locking handle positioned within the elevator shaft, and connected to a first end of a tension member; a blocking stop, which is connected to a second end of the tension member, and which is moveable between an inactive state, in which the tension member holds the blocking stop in a position in which it does not limit downwards movement of the counterweight, and an active state, in which tension in the tension member is reduced to allow the blocking stop to move to a position in which it limits downwards movement of the counterweight; and a safety switch arranged such that, when the safety device is in the deployed position, the safety switch is triggered and thereby causes the locking handle to move so as to reduce tension in the tension member, thereby allowing the blocking stop to move into the active state.

In an elevator assembly as disclosed herein, a user is provided with reassurance that the tension member provides a physical connection between the locking handle and the blocking stop so that, when the safety device is deployed, the locking handle physically moves to activate the blocking stop. Furthermore, there is provided a visual indication of whether the locking handle is in a first position (corresponding to the inactive state of the blocking stop) or has moved to a second position (corresponding to the active state of the blocking stop).

It is desirable, for safety purposes, for the active state of the blocking stop to be a default state. This can be conveniently achieved using the locking handle to put the tension member under tension when holding the blocking stop in the inactive state, so that the blocking stop tends to return to the active state in the absence of this tension. Thus, in one or more examples of the present disclosure, the locking handle further comprises a locking member arranged to hold the locking handle in a first position that holds the tension member under tension so as to hold the blocking stop in the inactive state. The locking member may comprise a mechanical, electrical or electromechanical locking member. In some examples, the locking member (e.g. a pin) is arranged to be moved by an electromagnetic actuator.

In one or more examples of the present disclosure, the locking handle further comprises an electromagnetic actuator arranged to release the locking member when the safety switch is triggered, so that the locking handle can move to a second position to reduce tension in the tension member, thereby allowing the blocking stop to move into the active state. It will be understood that tension in the tension member pulls on the locking handle so that the locking handle moves from the first position towards a second position of reduced tension where the blocking stop is by default in the active state whenever the safety device is deployed.

It is envisaged that the locking handle may be moved manually or automatically. In order to return the blocking stop to the inactive state, e.g. at the end of a maintenance procedure, the locking handle moves in reverse to the first position, causing the tension member to pull the blocking stop into the inactive state. In some examples, this may be achieved when a maintenance person exits the elevator shaft and a reset signal is sent to the locking handle, for example from a main elevator controller. However this requires the locking handle to be connected to a suitable automatic control system. In other examples, it is preferable for the locking handle to be manually moved in reverse to the first position. The application of manual force provides tactile feedback as the tension member pulls the blocking stop into the inactive state. Furthermore, this requires manual intervention at the end of a maintenance procedure and avoids accidental reset of the locking handle. Upon reaching the first position, the locking member may be activated (e.g. by activating the electromagnetic actuator using another switch triggered by the locking handle) to hold the blocking stop in the inactive state.

The locking handle may move linearly or rotationally, with a suitable system arranged to convert movement of the locking handle into a movement of the first end of the tension member which adjusts tension in the tension member. This may be achieved by translating the first end of the tension member or changing a travel path of the first end of the tension member, for example by wrapping the first end of the tension member around a rotary member. In one or more examples of the present disclosure, the locking handle comprises a rotary member connected to the first end of a tension member and a handle member arranged to turn the rotary member and thereby adjust tension in the tension member. In such examples, the handle member can be turned to manually turn the locking handle from the second position back to first position. The handle member provides a visual indication and a tactile feedback about whether the locking handle is in the first position (corresponding to the inactive state of the blocking stop) or the second position (corresponding to the active state of the blocking stop). The locking handle is directly connected to the blocking stop via the tension member, and hence its position provides reassurance of the active/inactive state of the blocking stop. In these examples, preferably the rotary member is arranged to turn between a preset first position corresponding to the inactive state of the blocking stop and a preset second position corresponding to the active state of the blocking stop.

In one or more examples of the present disclosure, in addition or alternatively, there may be provided at least one visual indicator (other than the locking handle position) of the blocking stop being in the active or inactive state. The visual indicator may take the form of one or more of: a light, a display sign, a flag. The visual indicator is preferably arranged independently of the locking handle, so as to provide a secondary level of reassurance.

In one or more examples of the present disclosure, the visual indicator is a traffic light system comprising a first light indicating that the blocking stop is in the active state and a second light indicating that the blocking stop is in the inactive state. In one or more examples, the visual indicator is electrically activated. The visual indicator may be electrically connected to the locking handle and rely on the locking handle position to determine the active/inactive state of the blocking stop. However, in at least some examples, the visual indicator is electrically connected to the blocking stop such that the visual indicator can give a direct indication of the blocking stop state. The electrical connection between the blocking stop and the visual indicator may be direct, or indirect e.g. via an elevator controller. This approach provides two indications of the blocking stop state; firstly through the position of the locking handle, and secondly through the state of the visual indicator, which can additionally indicate the blocking stop state in the case of a failure in the tension member. The use of two indicators provides redundancy in the system, reducing the likelihood of a maintenance person entering the elevator shaft when it is unsafe to do so.

The movement of the blocking stop(s) between the active and inactive states can be a translational or rotational movement. In at least some examples, the blocking stop is arranged to rotate into the active state. This means that gravity can assist in moving the blocking stop into the active state.

As mentioned above, it is desirable for the elevator assembly to ensure that the blocking stop(s) tend to move into the active state as a default. This can be further assisted, according to at least some examples, by the elevator assembly comprising at least one resilient member connected to the blocking stop. In at least some examples, the at least one resilient member is arranged to be extended when the blocking stop is moved to the inactive state by the tension member. In at least some examples, the at least one resilient member is arranged to relax when the tension is reduced and helps the tension member to move the blocking stop to the active state.

In one or more examples of the present disclosure, the elevator assembly comprises a first blocking stop connected to a first tension member and a second blocking stop connected to a second tension member, wherein the first and second tension members are connected to the locking handle. In such examples, the first and second blocking stops may be electrically connected in series to a visual indicator, such as the one disclosed above. This means that, if either of the first and second blocking stops is not in the active state, the visual indicator indicates the inactive state even if the locking handle has moved to indicate the active state for both.

It will be appreciated that various arrangements of blocking stops for a counterweight have been proposed in the prior art and may find use in an elevator assembly as disclosed herein. The blocking stop(s) may be mounted in any suitable way in the elevator shaft, for example mounted to a wall or other structure in the elevator shaft. In at least some examples, the blocking stop is mounted on a counterweight guide rail. The elevator assembly may further comprise at least one counterweight guide rail, and preferably a pair of counterweight guide rails, arranged to guide the upwards and downwards movement of the counterweight. It is convenient for the blocking stop(s) to be mounted to the counterweight guide rail(s). The tension member(s) may conveniently run alongside the counterweight guide rail(s).

There is further disclosed an elevator system comprising an elevator assembly as described herein.

BRIEF DESCRIPTION OF THE DRAWINGS

Certain exemplary embodiments of this disclosure will now be described with reference to the accompanying drawings, in which.

DETAILED DESCRIPTION

Figure 1:
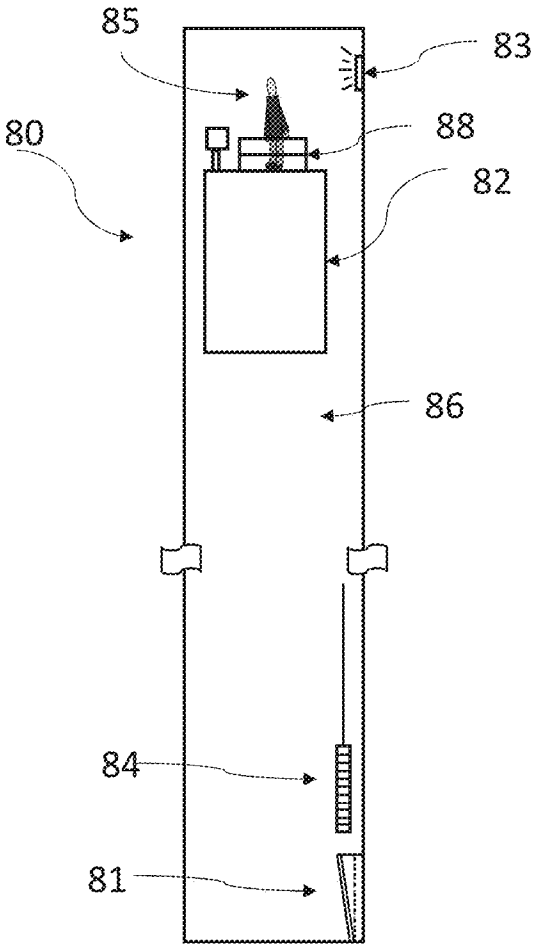
Fig. 1 Prior Art
FIG. 1 schematically illustrates an example elevator assembly according to the prior art.

FIG. 1 schematically illustrates selected portions of an elevator assembly 80 as known from the prior art. The elevator assembly 80 includes an elevator car 82 coupled to a counterweight 84 located within an elevator shaft 86. A safety device 88 is located on the roof of the elevator car 82. The safety device 88 can be deployed to provide a barrier function as shown in FIG. 1.

A blocking stop 81 is located in the pit of the elevator shaft 86, and is arranged to move, responsive to the safety device 88 being deployed, between a retracted position and a deployed position, in which it limits the movement of the counterweight 84 in a downward direction. In this way, movement of the elevator car 82 in an upward direction can be limited, allowing a maintenance person 85 to safely enter the elevator shaft 86 and work from the roof of the elevator car 82. The position of the blocking stop 81 can additionally be indicated by a visual indicator 83.

Figure 2:
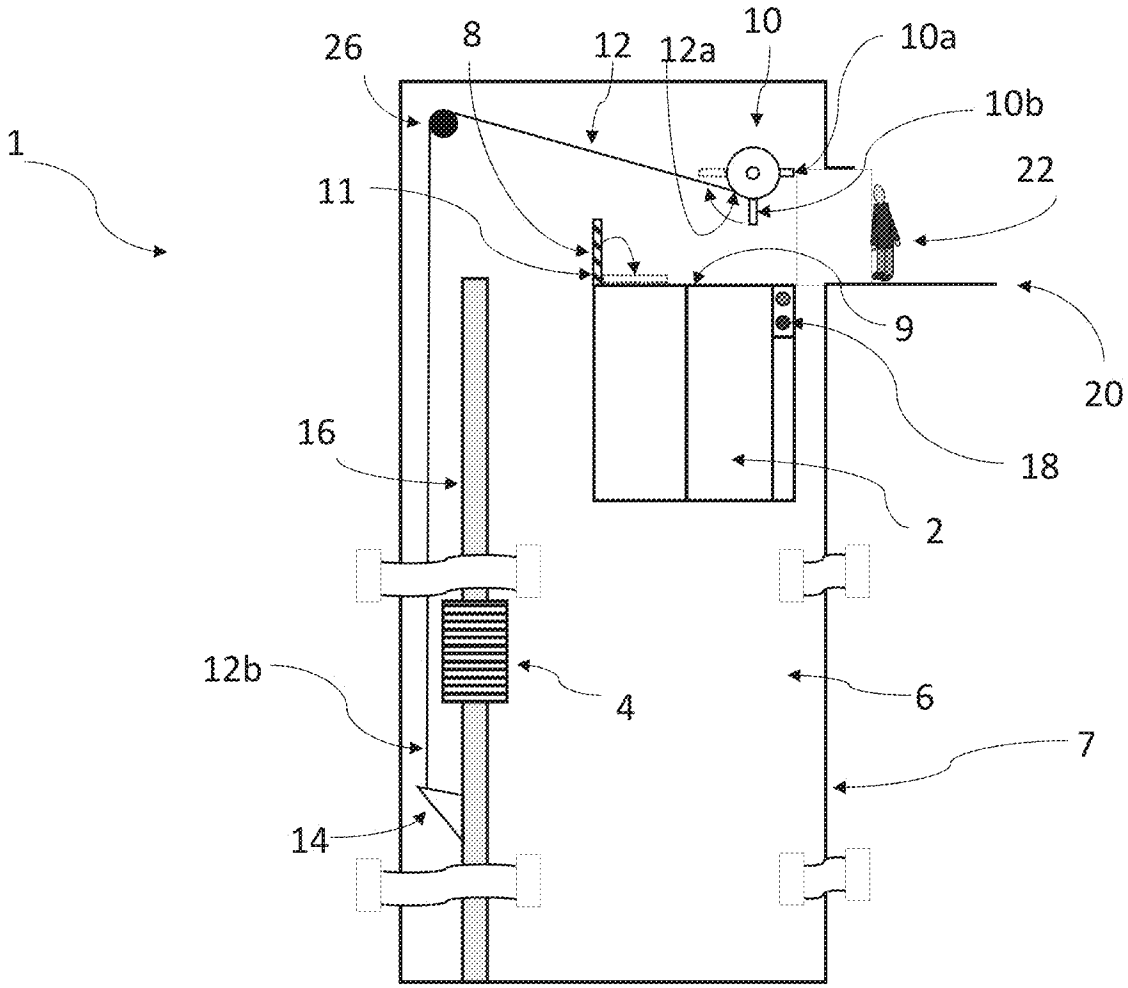
FIG. 2 schematically illustrates an example elevator assembly according to an example of the present invention.

FIG. 2 schematically illustrates selected portions of an elevator assembly 1 according to the present invention, that includes an elevator car 2 and a counterweight 4 located within an elevator shaft 6. The counterweight 4 is coupled to the elevator car 2 in any suitable manner, as defined by the prior art, for example using roping or belts (not shown) so as to move upwards and downwards in the elevator shaft 6 in response to movement of the elevator car 2.

The elevator assembly 1 further includes a locking handle 10 positioned within the elevator shaft 6. The locking handle 10 may be mounted on a wall of the elevator shaft 6 at such a position that it can be reached by a service technician 22 from the uppermost landing 20 when the elevator car 2 has been stopped for a maintenance procedure. The locking handle 10 includes a locking member 10*a* and handle member 10*b*.

When the elevator car 2 has been stopped for a maintenance procedure, it is desirable to prevent any upwards movement of the elevator car 2 by blocking downwards movement of the counterweight 4. This is achieved by activating one or more blocking stops 14, for example a blocking stop 14 seen in FIG. 2 positioned in a pit of the elevator shaft 6.

Figure 3B:
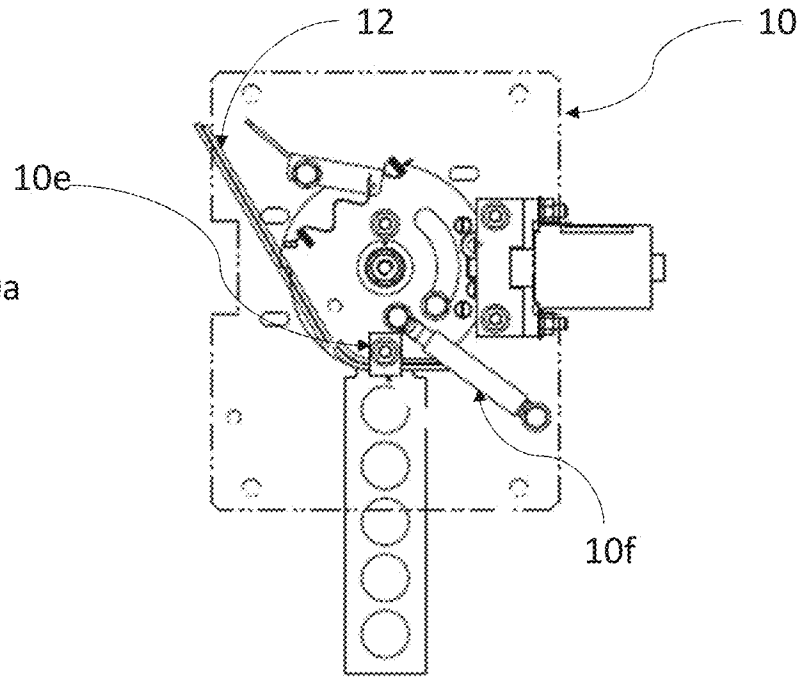
FIG. 3*b* schematically illustrates the arrangement of a tension member in the interior of the locking handle of FIG. 3*a;*

The locking handle 10 is coupled to the blocking stop 14 by a tension member 12, for example via a pulley 26 or other equivalent system for guiding the tension member 12. The tension member 12 may be a cable in some examples. As is more clearly seen in FIGS. 3*a* and 3*b*, the locking handle 10 is connected to a first end 12*a* of the tension member 12 by virtue of the tension member 12 being at least partially wrapped around a rotary member 10*c* (such as a drum). The tension member 12 is fixed in place to the locking handle 10 by a locking clamp 10*e*, as seen in FIG. 3*b*, which shows the arrangement of the tension member 12 in the interior of the locking handle 10.

Figure 3A:
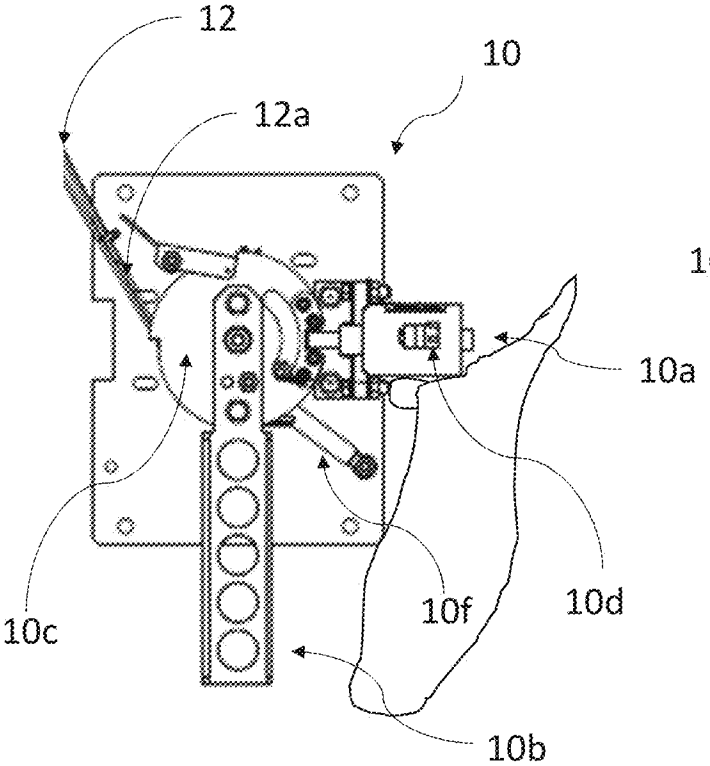
FIG. 3*a* is a close-up view of an exemplary locking handle.

With reference to FIG. 3*a*, the locking handle 10 is seen to include the rotary member 10*c*, a handle member 10*b* that can be grasped to turn the rotary member 10*c*, a locking member 10*a* and an associated electromagnetic actuator 10*d*. The locking member 10*a* is activated, e.g. when a current is applied to the electromagnetic actuator 10*d*, to hold the locking handle 10 in a first position (seen in FIG. 3*a*) that puts the tension member 12 under tension (i.e. the inactive state of the blocking stop 14). The electromagnetic actuator 10*d* is electrically connected to a safety switch, as will be described in more detail below. When the locking member 10*a* is released, e.g. by disconnecting the current to the electromagnetic actuator 10*d*, the locking handle 10 is free to move to a second position to reduce tension in the tension member 12 (i.e. the active state of the blocking stop 14). The motion of the locking handle may be aided by the use of a pneumatic piston 10*f* attached to the rotary member 10*c*.

In this example, the locking handle 10 moves in a rotary fashion. When the locking member 10*a* is released, the rotary member 10*c* is free to turn clockwise from a first (vertical) position (seen in FIGS. 3*a* and 3*b*), pulled by the tension member 12 so as to reduce tension in the tension member 12. This turns the handle member 10*b* from the first (vertical) position to the second (horizontal) position seen in phantom in FIG. 2. To return the locking handle 10 from the second position to the first position, the rotary member 10*c* can be manually rotated in reverse (i.e. anti-clockwise) by turning the handle member 10*b* back to the first (vertical) position shown in FIGS. 3*a* and 3*b*. This wraps more of the first end 12*a* of the tension member 12 around the rotary member 10*c*, increasing the tension and causing the tension member 12 to pull the blocking stop 14 back into the inactive state. Upon reaching the first position, the locking member 10*a* is re-activated (e.g. by activating the electromagnetic actuator 10*d* using another switch triggered by movement of the locking handle 10) to hold the locking handle 10 in the first position and hence hold the blocking stop 14 in the inactive state.

Returning to FIG. 2, it will be appreciated that, when the blocking stop 14 is held in the inactive state by tension in the tension member 12, the blocking stop 14 is not limiting downwards movement of the counterweight 4. A visual indicator 18 may display a warning (e.g. red) light. In this mode of operation, the elevator car 2 and the counterweight 4 may move close to the top and bottom of the elevator shaft 6 respectively. When the blocking stop 14 is in the active state, the counterweight 4 is prevented from moving to the bottom of the elevator shaft 6, preventing the elevator car 2 from moving to the top of the elevator shaft 6. This results in a space above the elevator car 2 being made available, allowing maintenance or inspection procedures to be safely carried out.

In this example, the counterweight 4 and the blocking stop 14 are located on a counterweight guide rail 16 located in the elevator shaft 6. However, in practice, the blocking stop 14 could instead be mounted on a wall 7 of the elevator shaft 6 or in any other suitable configuration close to the operational range of movement of the counterweight 4.

Figure 4:
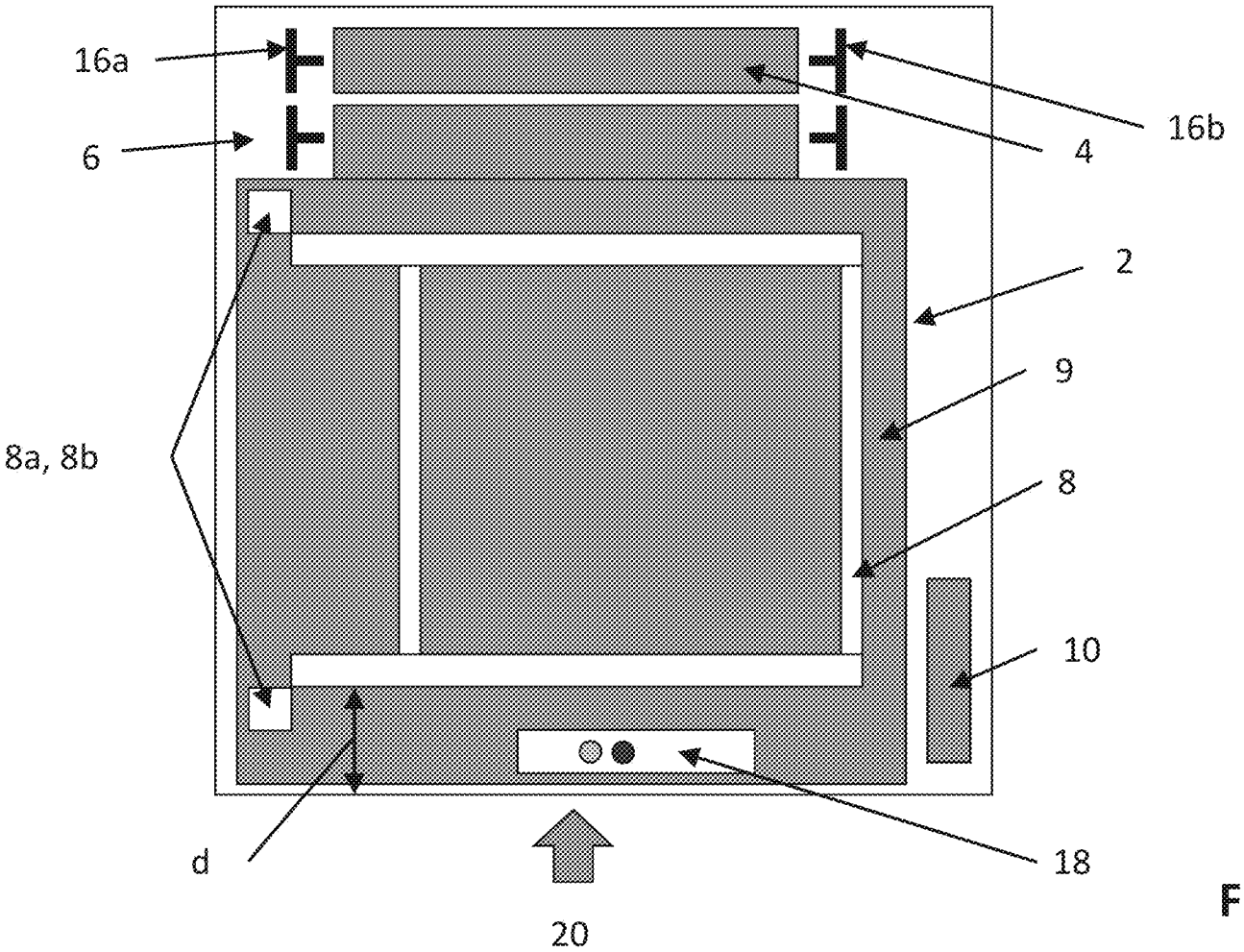
FIG. 4 schematically illustrates a plan view of an exemplary layout of an elevator assembly according to the present disclosure.

The elevator assembly 1 shown in FIG. 2 further includes a safety device 8 located on a roof 9 of the elevator car 2, that can be selectively moved between a deployed position and an undeployed position by an operator such as a service technician 22. In the deployed position shown in FIG. 2, the safety device 8 is positioned such that it extends away from the roof 9 of the elevator car 2, forming a physical safety barrier at the edge of the elevator car 2. The relative positions of the safety device 8 (when undeployed), the locking handle 10 and the elevator car 2 in the elevator shaft 6 are shown in FIG. 4.

During normal operation of the elevator car 2, the safety device 8 is stowed on the roof 9 of the elevator car in an undeployed position (seen in phantom in FIG. 2), such that the elevator car 2 may travel to the top of its operational range. In at least some examples, the safety device 8 is connected to the roof 9 of the elevator car 2 by, for example, a hinge, allowing it to be folded up from, and down to, the roof 9 of the elevator car to minimise its profile when not in use.

In certain situations, such as in the event that a maintenance procedure must be carried out, it is necessary to maintain a safe operating area above the elevator car 2 within the elevator shaft 6 to allow sufficient space for, e.g. a service technician 22 to have access to the roof 9 of the elevator car 2. In such situations, the safety device 8 is manually moved into the deployed position by, e.g. a service technician 22. In some examples, the safety device 8 is accessible from the landing 20 such that it can be moved into the deployed position without entry into the elevator shaft 6.

The elevator assembly 1 includes a safety switch 11 (such as a position switch) which is triggered when the safety device 8 is moved into the deployed position, causing the locking member 10*a* of the locking handle 10 to release, and allowing the locking handle 10 to move into the second position in which the tension in the tension member 12 is reduced, allowing the blocking stop 14 to move into an active state in which it limits the downwards motion of the counterweight 4. This movement of the locking handle 10 provides a first visual indication of whether or not the blocking stop 14 is active, which can be confirmed from the state of the visual indicator 18, from which it can be determined whether it is safe for a service technician 22 to enter the elevator shaft 6.

When a service technician 22 has finished a maintenance operation, he/she may leave the elevator shaft 6 and stow away the safety device 8. The locking handle 10 can then be manually operated from the landing 20. Moving the locking handle 10 in a reverse direction pulls the blocking stop 14 into an inactive position via the tension member 12, and allows the elevator car 2 and the counterweight 4 to return to a normal range of operation. As discussed above, the locking member 10*a* is activated to hold the blocking stop 14 in the inactive state via the tension member 12.

FIG. 4 shows the general layout of some components of the elevator assembly in the elevator shaft 6. The counterweight 4 is guided by counterweight rails 16*a*, 16*b* to run alongside the elevator car 2. The locking handle 10 is mounted to a wall of the elevator shaft 6 in a position that can be reached by a person wishing to enter from the landing 20. The safety device 8 is mounted on the roof 9 of the elevator car 2. The safety device 8 has two pivot points 8*a*, 8*b* so that the safety device 8 can be pivoted down from its deployed position to an undeployed position in which it is stowed flat on the roof 9. It can be seen that there is only a small distance d between the safety device 8 and the landing 20.

In this example, the elevator assembly 1 further includes a visual indicator 18, mounted on the roof 9 of the elevator car 2, which shows whether the blocking stop 14 is in the active state or inactive state, and hence provides further indication of whether it is safe for a service technician 22 to enter the elevator shaft 6. The visual indicator 18 is, for example, a traffic light system with two lights, e.g. a green light illuminated when the blocking stop 14 is in the active state and a red light illuminated when the blocking stop 14 is in the inactive state.

Figure 5A:
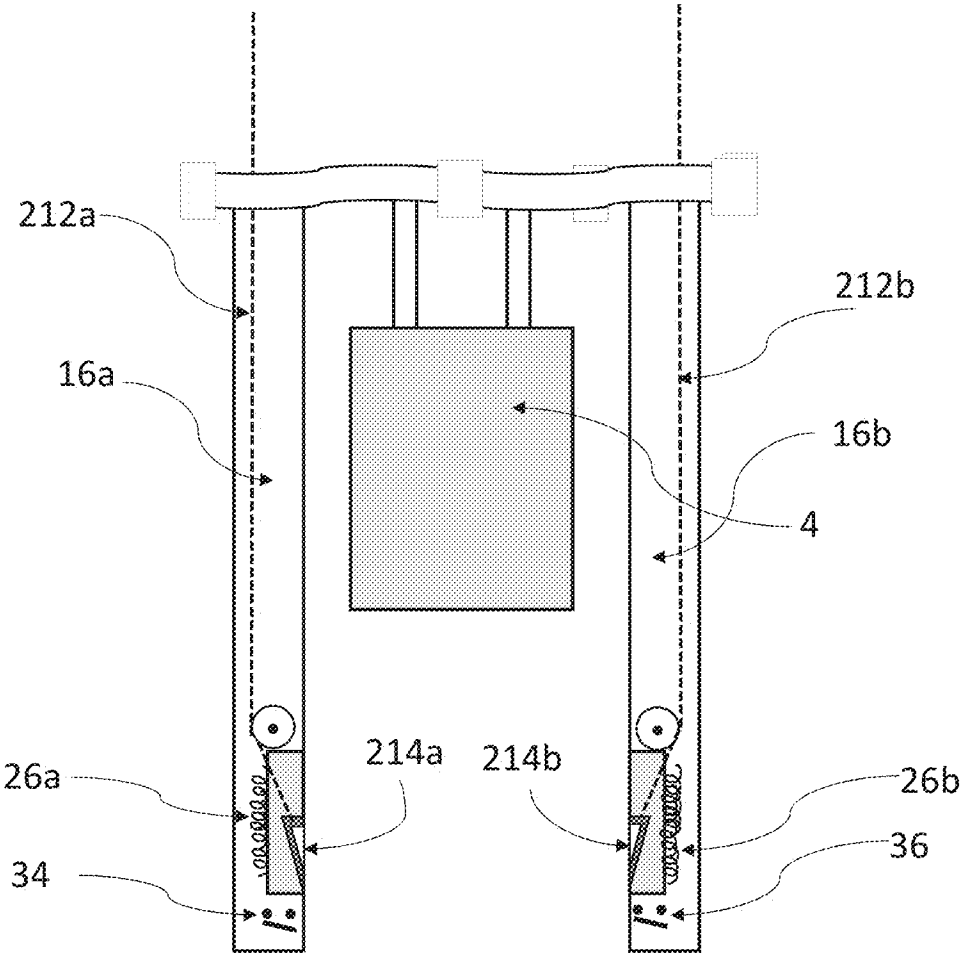
FIG. 5*a* schematically illustrates an example with two blocking stops in an inactive state.
Figure 5B:
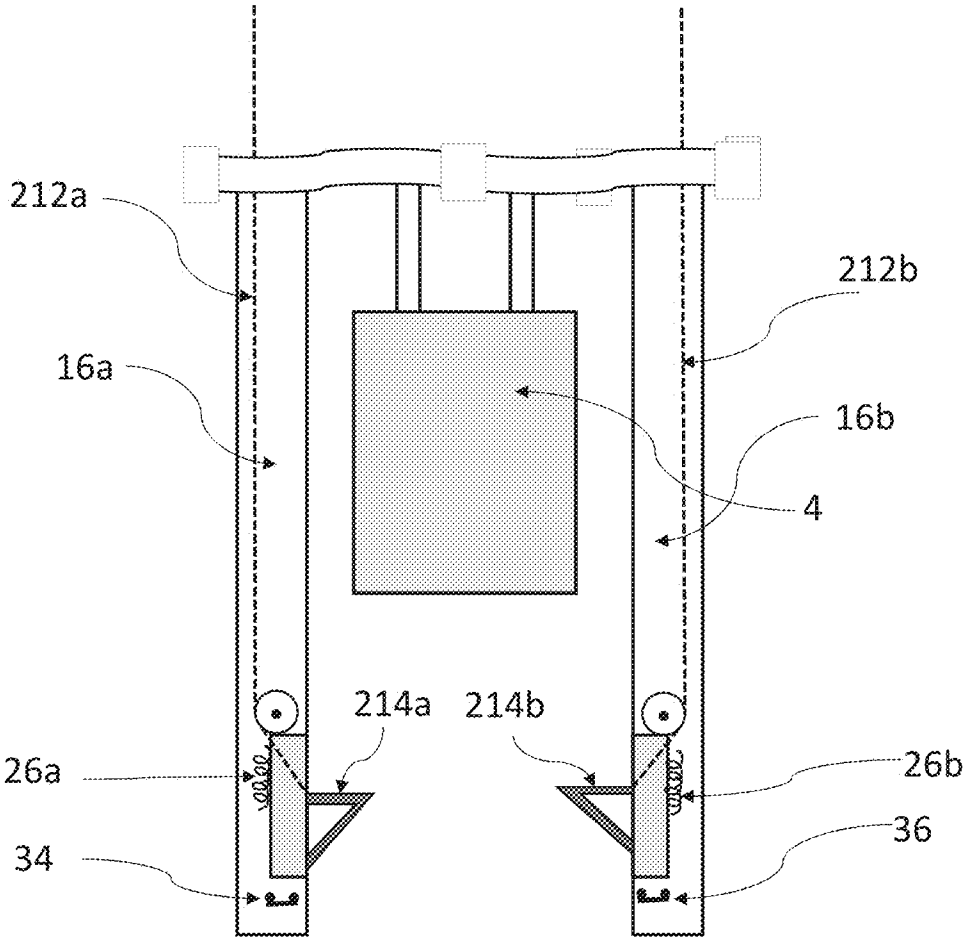
FIG. 5*b* schematically illustrates an example with two blocking stops in an active state.

FIGS. 5*a* and 5*b* represent a particular example, in which the counterweight 4 is mounted on a pair of counterweight guide rails 16*a*, 16*b*, with two blocking stops, 214*a* and 214*b*, each located on one of the counterweight guide rails 16*a*, 16*b*. The two blocking stops 214*a*, 214*b* are operably connected to the locking handle 10 by two tension members 212*a* and 212*b* respectively. The tension members 212*a* and 212*b* may be diverted from the locking handle 10 to the blocking stops 214*a*, 214*b* by a system of deflection sheaves, such that the two tension members 212*a*, 212*b* are connected in parallel to the locking handle 10.

FIGS. 5*a* and 5*b* also show two resilient members 26*a* and 26*b* in the form of spring coils. The resilient members 26*a*, 26*b* are employed such that they are extended when the blocking stops 214*a*, 214*b* are in the inactive state, i.e. when the tension members 212*a*, 212*b* are held under sufficient tension, as shown in FIG. 5*a*. In this manner, when the locking handle is moved to reduce the tension in the tension members 212*a*, 212*b*, the resilient members 26*a*, 26*b* relax, helping to forcibly move the blocking stops 214*a*, 214*b* into the active state, shown in FIG. 5*b*. When the locking handle 10 is moved in the reverse direction, increasing the tension in the tension members 212*a*, 212*b*, the resilient members 26*a*, 26*b* are extended, and the blocking stops 214*a*, 214*b* pulled into and held in the inactive state by the tension members 212*a*, 212*b*. The resilient members 26*a*, 26*b* can be held in the extended state until they are subsequently released when the position of the locking handle 10 is moved, for example, during the next maintenance operation.

As shown schematically in FIGS. 5*a* and 5*b*, each of the blocking stops 214*a*, 214*b* is operatively connected to a position switch 34, 36. The function of these switches 34, 36 is described below with reference to FIG. 6. The first and second blocking stops 214*a*, 214*b* are electrically connected in series to the visual indicator 18 via these position switches 34, 36.

Figure 6:
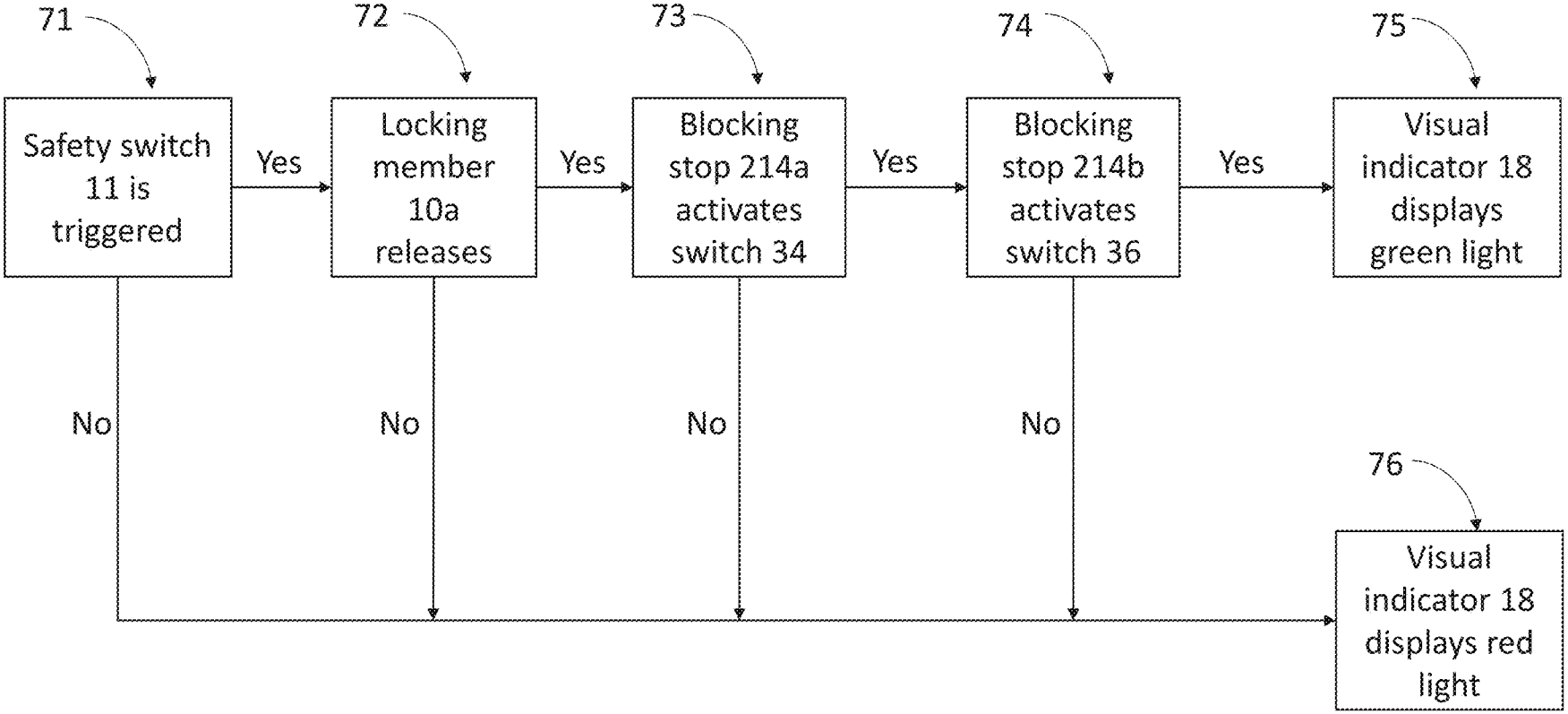
FIG. 6 is a schematic block flow diagram representing some functional connections between some components in an exemplary elevator assembly.

FIG. 6 shows a schematic block flow diagram representing the activation of the blocking stops 214*a*, 214*b* in the example shown in FIGS. 5*a* and 5*b*, as would take place during, for example, a maintenance operation. A service technician 22 first moves the safety device 8 into the deployed position, which should trigger the safety switch 11 at step 71. The triggering of the switch 11 activates the electromagnetic actuator 10*d* in the locking handle 10, releasing the locking member 10*a* (step 72) and allowing the locking handle 10 to turn from its first position to its second position, reducing the tension in the tension members 212*a*, 212*b*. This should result in the blocking stops 214*a*, 214*b* moving to the active state in which downwards movement of the counterweight 4 is limited, and providing a safe space above the elevator car 2 for the service technician 22 to enter the elevator shaft 6 (steps 73, 74). If the locking handle 10 is not seen to turn to its second position, and no change is seen in the state of the visual indicator 18, then the service technician 22 will realise that the blocking stops 214*a*, 214*b* have not been moved correctly into the active state.

Furthermore, the visual indicator 18 is designed to confirm to the service technician 22 that it is safe to enter the elevator shaft 6, in which case the visual indicator 18 may display a green light, shown in block 75. Alternatively, a red light is displayed, as shown in block 76, indicating that it is potentially unsafe to enter the elevator shaft 6. In order to detect that the blocking stops 214*a*, 214*b* have correctly moved into the active state, the two blocking stops 214*a*, 214*b* move into contact with switches 34 and 36 respectively. The switches 34 and 36 are connected to the green light in series, such that if either of the switches 34, 36 is not triggered, i.e. in the event that one of the blocking stops 214*a*, 214*b* has not moved into the active state, the green light is not illuminated, and instead the red light is illuminated. Of course, any other colours or types of indicator may be implemented in the visual indicator 18.

It will be appreciated by those skilled in the art that the disclosure has been illustrated by describing one or more specific examples thereof, but is not limited to these examples; many variations and modifications are possible, within the scope of the accompanying claims.

What is claimed is:

1. An elevator assembly (1), comprising:

an elevator car (2) arranged to move in an elevator shaft (6);

a counterweight (4) coupled to the elevator car (2) and arranged to move upwards and downwards in the elevator shaft (6);

a safety device (8) located on a roof (9) of the elevator car (2) and moveable between a deployed position, in which it extends away from the roof (9) of the elevator car (2), and an undeployed position in which it is stowed on the roof (9) of the elevator car;

a locking handle (10) positioned within the elevator shaft (6), and connected to a first end (12*a*) of a tension member (12; 212*a*, 212*b*);

a blocking stop (14; 214*a*, 214*b*), which is connected to a second end (12*b*) of the tension member (12; 212*a*, 212*b*), and which is moveable between an inactive state, in which the tension member (12; 212*a*, 212*b*) holds the blocking stop (14; 214*a*, 214*b*) in a position in which it does not limit downwards movement of the counterweight (4), and an active state, in which tension in the tension member (12; 212*a*, 212*b*) is reduced to allow the blocking stop (14; 214*a*, 214*b*) to move to a position in which it limits downwards movement of the counterweight (4); and a safety switch (11) arranged such that, when the safety device (8) is in the deployed position, the safety switch (11) is triggered and thereby causes the locking handle (10) to move so as to reduce tension in the tension member (12; 212*a*, 212*b*), thereby allowing the blocking stop (14; 214*a*, 214*b*) to move into the active state.

2. The elevator assembly (1) of claim 1, wherein the locking handle (10) further comprises a locking member (10*a*) arranged to hold the locking handle (10) in a first position that puts the tension member (12; 212*a*, 212*b*) under tension so as to hold the blocking stop (14; 214*a*, 214*b*) in the inactive state.

3. The elevator assembly (1) of claim 2, wherein the locking handle (10) further comprises an electromagnetic actuator (10*d*) arranged to release the locking member (10*a*) when the safety switch (11) is triggered, so that the locking handle (10) can move to a second position to reduce tension in the tension member (12; 212*a*, 212*b*), thereby allowing the blocking stop (14; 214*a*, 214*b*) to move into the active state.

4. The elevator assembly (1) of claim 1, wherein the locking handle (10) comprises a rotary member (10*c*) connected to the first end (12*a*) of the tension member (12; 212*a*, 212*b*) and a handle member (10*b*) arranged to turn the rotary member (10*c*) and thereby adjust tension in the tension member (12; 212*a*, 212*b*).

5. The elevator assembly (1) of claim 1, further comprising at least one visual indicator (18) of the blocking stop (14; 214*a*, 214*b*) being in the active or inactive state.

6. The elevator assembly (1) of claim 5, wherein the visual indicator is a traffic light system (18) comprising a first light indicating that the blocking stop (14; 214*a*, 214*b*) is in the active state and a second light indicating that the blocking stop (14; 214*a*, 214*b*) is in the inactive state.

7. The elevator assembly (1) of claim 5, wherein the visual indicator (18) is electrically connected to the blocking stop (14; 214*a*, 214*b*).

8. The elevator assembly (1) of claim 1, comprising at least one resilient member (26*a*, 26*b*) connected to the blocking stop (14; 214*a*, 214*b*).

9. The elevator assembly (1) of claim 8, wherein the at least one resilient member (26*a*, 26*b*) is arranged to be extended when the blocking stop (14; 214*a*, 214*b*) is moved to the inactive state by the tension member (12; 212*a*, 212*b*).

10. The elevator assembly (1) of claim 8, wherein the at least one resilient member (26*a*, 26*b*) is arranged to relax when the tension is reduced and help the tension member (12; 212*a*, 212*b*) to move the blocking stop (14; 214*a*, 214*b*) to the active state.

11. The elevator assembly (1) of claim 1, wherein the blocking stop (14; 214*a*, 214*b*) is arranged to rotate into the active state.

12. The elevator assembly (1) of claim 1, wherein the blocking stop (14; 214*a*, 214*b*) is mounted on a counterweight guide rail (16; 16*a*, 16*b*).

13. The elevator assembly (1) of claim 1, comprising a first blocking stop (214*a*) connected to a first tension member (212*a*) and a second blocking stop (214*b*) connected to a second tension member (212*b*), wherein the first and second tension members (212*a*, 212*b*) are connected to the locking handle (10).

14. The elevator assembly of claim 13, wherein the first and second blocking stops (214*a*, 214*b*) are electrically connected in series to a or the visual indicator (18).

15. An elevator system comprising the elevator assembly (1) of claim 1.

* * * * *